United States Patent [19]

Mahncke et al.

[11] 4,288,881

[45] Sep. 15, 1981

[54] BRIDGE LAYING APPARATUS

[75] Inventors: Jürgen Mahncke, Korntal; Hans Weigele, Stuttgart; Dieter Hotz, Ditzingen, all of Fed. Rep. of Germany

[73] Assignee: Dr. Ing. h.c.F. Porsche Aktiengesellschaft, Stuttgart, Fed. Rep. of Germany

[21] Appl. No.: 87,865

[22] Filed: Oct. 24, 1979

[30] Foreign Application Priority Data

Oct. 24, 1978 [DE] Fed. Rep. of Germany ..... 2846182

[51] Int. Cl.[3] ..... E01D 15/12

[52] U.S. Cl. ..... 14/2.4

[58] Field of Search ..... 14/2.4, 2.6, 27, 1

[56] References Cited

U.S. PATENT DOCUMENTS

| | | | |
|---|---|---|---|
| 3,486,180 | 12/1969 | Soffge | 14/2.4 |
| 3,491,391 | 1/1970 | Soffge | 14/2.4 |
| 3,820,181 | 6/1974 | Wagner | 14/2.4 |
| 4,023,226 | 5/1977 | Soffge | 14/2.4 |

FOREIGN PATENT DOCUMENTS

| | | | |
|---|---|---|---|
| 2530359 | 1/1977 | Fed. Rep. of Germany | 14/2.4 |
| 2641807 | 3/1978 | Fed. Rep. of Germany | 14/2.4 |

*Primary Examiner*—Nile C. Byers, Jr.
*Attorney, Agent, or Firm*—Craig and Antonelli

[57] ABSTRACT

A bridge laying apparatus of the type having a vehicle and at least two bridge sections which are transportable thereon in a superimposed position and are joinable into a bridge for spanning an obstacle by devices carried by the vehicle. The bridge includes plural tracks connected to one another via crossbeams and the device is arranged and guided between the bridge tracks and includes a launching girder that is partially embedded within a laying beam and supported by roller pairs arranged on both sides of the launching girder, a respective one of the rollers of these roller pairs serving for guiding and supporting the bridge on the laying beam and the other roller of the roller pairs serving for guiding and supporting the launching girder in the bridge. A guide arm is articulated to the vehicle and the laying beam is held thereon by rollers which enable longitudinal displacement of the laying beam on the guide arm. The guide arm is shiftable about a horizontal axis by way of a hydraulic cylinder unit. The bridge can be laid in place with or without the use of the launching girder, depending upon the length of the obstacle spanned thereby.

18 Claims, 15 Drawing Figures

BRIDGE LAYING APPARATUS

BACKGROUND AND SUMMARY OF THE INVENTION

The invention relates to a bridge laying apparatus comprising a vehicle with devices for supporting at least two bridge sections composable into a bridge and being superimposed during transport, as well as devices for the composition and laying of the bridge, wherein the bridge tracks are connected to one another via crossbeams and the laying apparatus is arranged and guided between these bridge tracks.

A bridge laying apparatus has been known (DAS [German Published Appliction] 1,658,604) exhibiting a telescopic supporting arm extensible in the longitudinal direction of the bridge, this arm being arranged between the bridge tracks, the bridge being displaceably supported on this arm. This support is pivotably articulated to the vehicle and has a projection at the free support end serving for laying the bridge and being in engagement with the bridge during this procedure. After termination of the laying process, the extensible parts of the supporting arm are again telescoped inwardly. Such a device is expensive from a constructional viewpoint and heavy for the laying of bridges having relatively large lengths, since the supporting arm must in each case exhibit the length of the bridge to be laid, which requires, in case of long bridges, a large number of telescoping strokes as well as control devices for retraction and extension. Besides, a relatively long telescoping cantilever arm tends to sag considerably, which substantially impairs the function of the support during laying. Such a laying system with a telescoping supporting arm is provided furthermore only for laying one bridge length or one type of bridge, which extensively reduces the usage possibilities for such a device.

It is an object of the invention to provide, as contrasted to the above, a bridge laying apparatus eliminating these disadvantages and being usable for the laying of differing types of bridges and bridge lengths, and which consequently can be adapted to various utilizations.

This object has been attained in accordance with a preferred embodiment of the invention by providing that a laying beam with a launching girder partially embedded therein constitutes the laying device, the latter being longitudinally displaceably supported, via a guide means, at the vehicle as well as the crossbeam and being equipped with roller pairs arranged on the side of the bridge and mounted on both sides of the launching girder, respectively one of the rollers of these roller pairs serving for the guidance and support of the bridge on the laying beam and the further roller serving for the guidance and support of the launching girder in the bridge.

Furthermore, provision is made according to an aspect of the invention to support the laying beam on a guide arm articulate on the side of the vehicle, this guide arm carrying the guide means of the laying beam and comprising rollers running on both sides of the beam in guide tracks. In particular, the guide arm is pivotably articulated in the forward region of the vehicle about a horizontal axis and can be adjusted to high and low levels via a hydraulic cylinder, wherein the laying beam has a U-shaped profile open toward the topside of the bridge. The launching girder is held at the crossbeam in the hollow space of the profile, surrounded by the sidewalls of the beam. To extend the launching girder and for the displacement of the bridge, a worm and nut drive mechanism as well as a chain drive mechanism are provided in the laying beam. To connect the launching girder with the laying beam, the laying beam has on its end facing the end of the launching girder a gripping device establishing a rigid connection in the longitudinal direction of the bridge. This gripping device comprises a spring-loaded catch hook as well as a correspondingly fashioned opening in the launching girder for receiving the catch hook.

Still further, provision is made according to another aspect of the invention to provide the launching girder with a launching girder tip at its free forward end consisting of a controllable hydraulic cylinder privotably mounted to the girder, and a sole plate facing the terrain.

By means of the invention, a bridge laying apparatus has been created which is composed of a small number of constructionally simple and lightweight components, wherein these components in total result in a system which can be varied in dependence on the particular application. Thus, it is possible, for example, to lay without any problems various types of bridges, as well as bridges of varying lengths, within a minimum period of time. The laying of short bridges does not require a launching girder; the latter becomes necessary only if bridges of a relatively large length are to be laid. Since this launching girder remains in the thus-installed bridge, it is also possible without any complicated alterations to disassemble such bridge, as well as to lay bridges of varying lengths in succession. Furthermore, the laying apparatus is equally well suitable for caterpillar vehicles as well as wheel-type vehicles. Due to the fact that the launching girder remains in the laid bridge, a central cover is provided for the two lanes joined by way of crossbeams, resulting in additional safety for vehicle and personnel.

These and further objects, features and advantages of the present invention will become more obvious from the following description when taken in connection with the accompanying drawings which show, for purposes of illustration only, a single embodiment accordance with the present invention.

DETAILED DESCRIPTION OF THE PREFERRED EMBODIMENT

Figure 1:
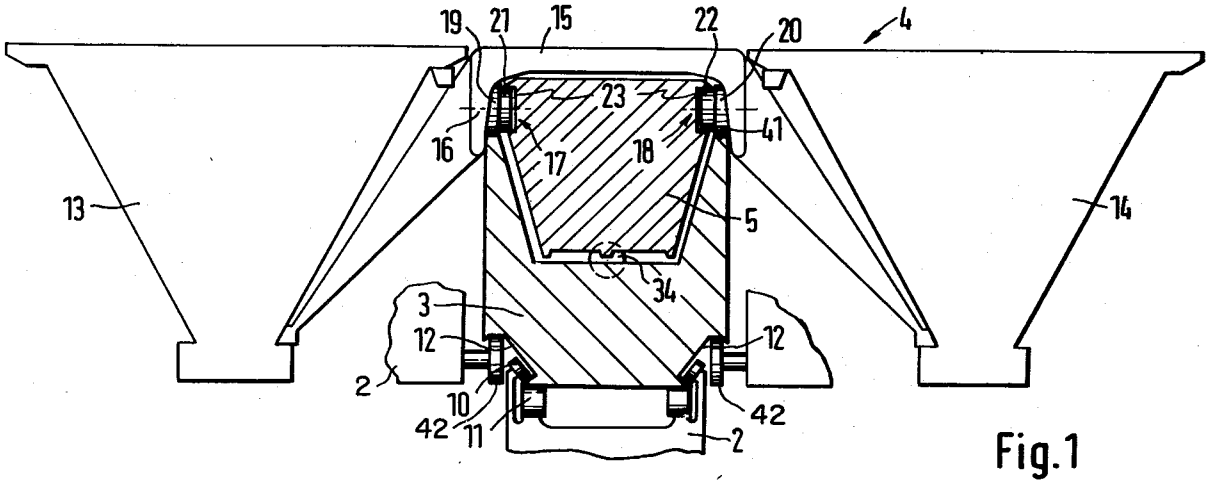
FIG. 1 is a cross section through a bridge with two track lanes and with a laying beam with launching girder, one nestled inside the other, in a schematic view.

The bridge laying apparatus comprises essentially a guide arm 2 articulated to a vehicle 1, a laying beam 3 being held on this guide arm in a longitudinally displaceable fashion and serving for the guidance and support of a bridge 4. A launching girder 5 is arranged in the laying beam 3 and is partially encompassed by the latter; the drive mechanisms 6 for the bridge 4 and for the launching girder 5 are accommodated therein. The vehicle 1 is supported by way of props 7 and 8 at the front and rear and has a coupling arm 9 at the rear, by way of which the bridge sections, arranged on the vehicle 1 in a superimposed relationship for transporting purposes, are placed into a series-type position and can be coupled together in this position.

As shown in greater detail in FIG. 1, the laying beam 3 is made of a U-shaped profile in cross section and is held via rollers 10, 11, and 42 on the guide arm 2 to be pivotable and longitudinally displaceable. The guide arm 2 is pivotable about an axle 36 under action of hydraulic cylinder 37, and carries the rollers 10, 11, and 42 which extend underneath the laying beam 3 on the bottom side and run in laterally open guide tracks 12. In the hollow space of the U-shaped profile of the laying beam 3, open toward the top, the launching girder 5 is arranged so that it is embedded therein while being encompassed by the sidewalls of the beam 3; the launching girder slightly projects beyond the beam.

Figure 9:
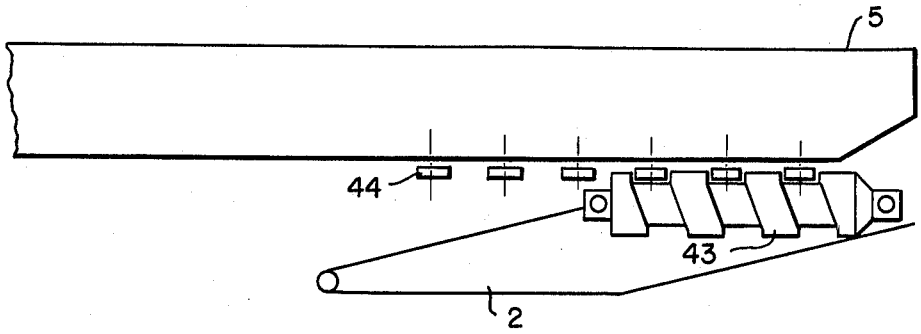
FIG. 9 is a partial sectional view through a guide arm and launching girder schematically representing a drive for the launching girder.

Furthermore, a drive unit for the advancement of the laying beam 3 is provided in the guide arm 2. This drive unit is shown in FIG. 9 and comprises a motor drive worm gear 43 carried by the guide arm 2 and rollers 44 attached to the bottom side of launching girder 5. Upon rotation of the worm gear the rollers are displaced axially along the groove of the gear into which they mesh. This movement of the rollers causes displacement of the launching girders relative to guide arm 2.

The bridge 4 comprises several coupled-together bridge sections, wherein each bridge section has two track lanes 13 and 14, respectively, joined by way of at least two crossbeams 15 extending above the launching girder 5.

Roller pairs 17 and 18 supported on an axle 16 are arranged on the insides of each crossbeam 15; these roller pairs receive between them the launching girder 5. Respectively one of the rollers 19 and 20 of each roller pair 17 and 18 serves for the guidance or support of the bridge 4 at the laying beam 3, and the further rollers 21 and 22 serve for the guidance or support of the launching girder 5 in the bridge 4. To receive the rollers 21 and 22, the launching girder 5 is provided with guide tracks 23 open toward the side.

Figure 8:
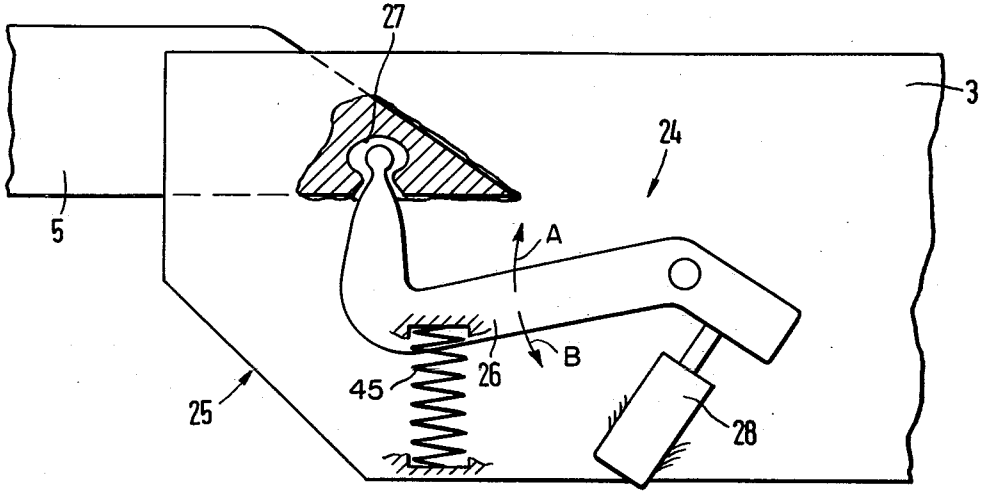
FIG. 8 shows a gripping device in a lateral view.
Figure 7:
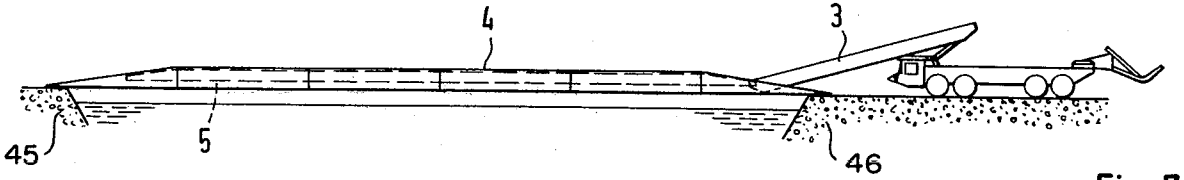

To connect the laying beam 3 to the launching girder 5 in the extended position, a gripping device 24 is provided held at the forward end 25 of the laying beam 3. This device comprises a catch hook 26 which is biased by a spring 45 in the direction A (FIG. 8) toward the launching girder 5. The hook 26 automatically locks into an opening 27, corresponding in shape to the tip **26*a* of the catch hook 26, of the launching girder 5 when the latter has reached its final position during the layer step under the effect of spring 45. The catch hook 26 is pivotably articulated and can be controlled by way of a hydraulic cylinder 28 so as to be withdrawn from opening 27 in direction B to separate the launching girder 5 from the laying beam 3 after the bridge has been positioned such as shown in FIG. 7. As will be appreciated, the bulbous tip 26*a* of the catch hook and complementarily shaped opening provide an effective detachable coupling that will axially secure laying beam 3 and girder 5 while permitting relative angular movement therebetween (compare positions shown in FIG. 2**).

At the forward, free end of the launching girder 5 a launching girder tip 29 is arranged that includes a hydraulic cylinder 30 that is connected to a sole plate 30 so that tip 29 is supported in a pivotable fashion upon sole plate 39. Thus, a pivoting action can be executed in the longitudinal extension of the girder when the launching girder 5 is retracted. By means of this launching girder tip 29, the launching girder 5 is held in an elevated position with respect to the bridge 4, so that the bridge 4 can be deposited without problems underneath the launching girder 5.

Figure 10A:
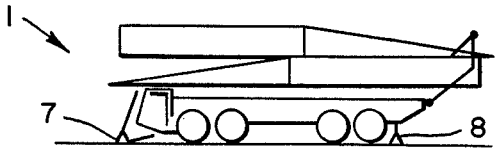
FIGS. 10*a–e* are schematic representations of the steps for bringing the bridge sections from their superimposed position to a composed position.
Figure 10B:
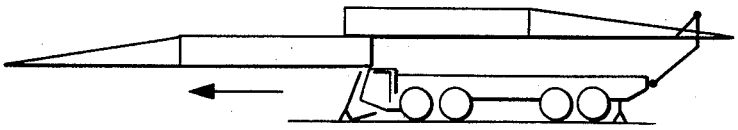
Figure 10C:
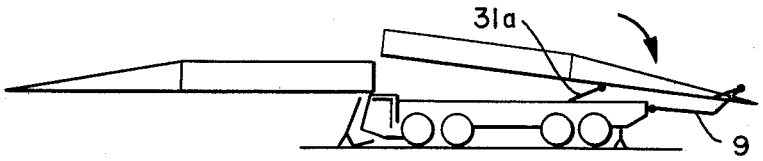
Figure 10D:
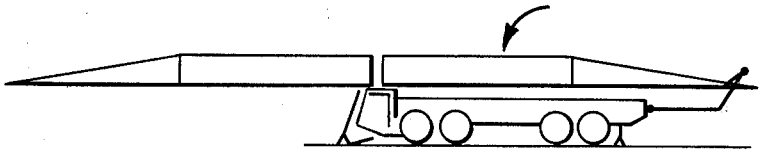
Figure 10E:
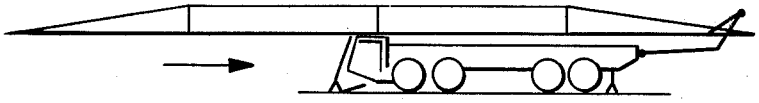

For the laying of the bridge 4, the wheel-type vehicle 1 is moved toward the obstacle to be spanned (river, ravine, etc.) in the transporting condition (bridge halves being in superimposed relationship, FIG. **10*a*). The vehicle is supported at the front and at the rear by the props 7, 8 and the coupling together of the superimposed bridge halves can now be initiated. The bridge half located at the bottom is extended (FIG. 10*b*), together with the laying beam, into the forward end position of the latter. Thereafter, the auxiliary arm 31*a* pertaining to the coupling system supports the bridge section lying on top (FIG. 10*c*), and the auxiliary arm 31 and the coupling arm 9 together move this bridge section downwardly into the coupling position (FIG. 10*d*). The positions of both auxiliary arm 31*a* and coupling arm 9 are controlled by electrically controlled hydraulic cylinder units. By moving the forward bridge section backwards, the two bridge halves are joined together by way of automatically engaging couplings which interlock upon head-on driving of the bridge sections together (FIG. 10*e***) and conventionally comprise gripping jaws on one bridge section end which grasp tongue-like members on the other. Since such couplings are well known and do not form part of the present invention, further detailed descriptions thereof are omitted.

This procedure is the same for all bridges having a length of 28 meters. If, in contrast thereto, longer bridges are to be laid, then one or more additional partial sections must be added by coupling.

After the coupling of the bridge halves and optionally of the launching girder parts, the laying device then takes care of laying the bridge 4, either with free launching or with the aid of the launching girder 5. When conducting the laying step with free launching, the bridge 4 moves forward on the laying beam 3, this advancement being effected by the chain drive mechanism 6. During this process the bridge 4 is supported on rollers 19, 20 mounted at the crossbeams 15 of the bridge tracks 13 and 14; these rollers can travel forward on the guide tracks 41 of the laying beam 3. Initially, as the bridge 4 travels forward upon the rollers 19, the bridge is in a balanced condition upon the vehicle. However, as a progressively greater portion of the bridge extends forwardly of the vehicle, a condition of imbalance which seeks to cause the bridge to tip downwards occurs. To this end, the bridge is provided with rollers 40 on the ramp 33 (FIG. 2) which engage underneath the launching girder 5. Downward pivoting is therefore prevented by the co-acting effects of the rollers 17, 18 engaging at the top of the girder 5 while the rollers 40 engage underneath the girder 5, and avoids downward swinging or tipping of the bridge 4 once a condition of imbalance occurs, yet enables relative angular swiveling of the bridge 4 relative to the laying beam 5 when the bridge is lowered into position on the bank of the obstacle to be spanned (FIG. 2, I and II positions which respectively represent lowering the bridge into place upon a surface on even level with the ground surface supporting the vehicle 1 and onto a bank located below the level upon which the vehicle is supported).

Figure 11:
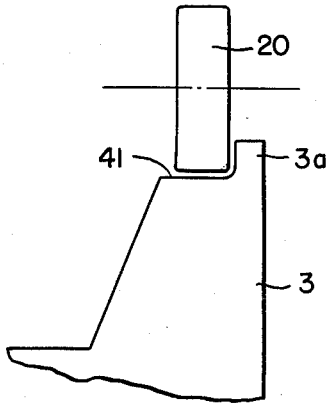
FIG. 11 is a partial sectional view through the launching beam showing a roller supporting track.

Thus, in this laying system, the bridge 4 can advance until the last crossbeam 15 is still securely supported in the laying beam 3 with roller 19, 20, and can then be freely laid down. The guide tracks 41 along which these rollers travel are open toward the top so that the rollers can freely lift off during the pivoting away of the laying beam 3 and the bridge 4 can firmly be placed on the ground without difficulties. Any occurring lateral forces during the laying process are absorbed by the outer edges 3*a* of the guide tracks 41 (formed on laying beam 3, FIG. 11) which thus guide the bridge 4.

Figure 4:
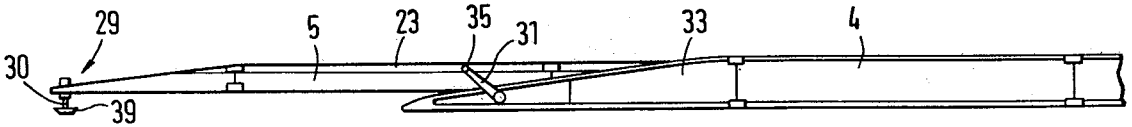
FIG. 4 is a lateral view with launching girder as well as with the bridge tip and the tip of the launching girder.
Figure 5:
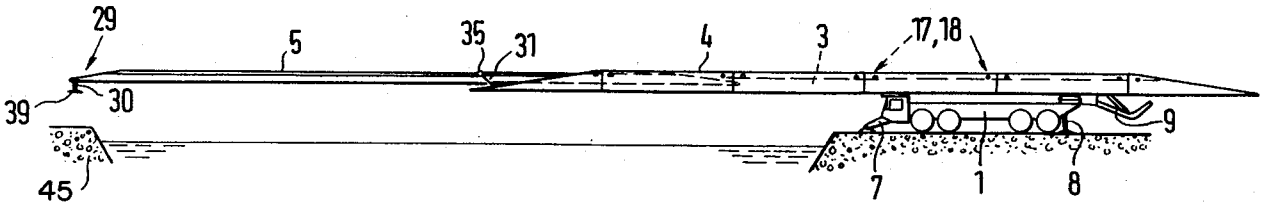
FIGS. 5, 6, and 7 show a laying procedure for a 42-meter bridge with launching girder from a wheel-type vehicle.
Figure 6:
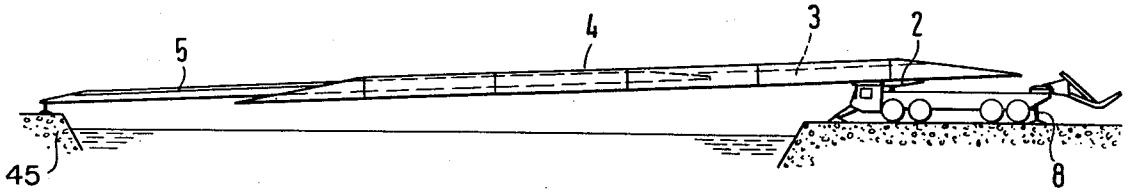

The procedure is essentially the same when laying bridges 4 with a launching girder 5, the only difference being that here the tendency of the bridge 4 is to tip downward, occurring above all in case of large bridge lengths, is compensated for by the launching girder 5 which acts as a beam supported at both ends on the opposite banks. Since the launching girder is staggered in exactly the same lengths as the lengths of the bridge 4, the coupling procedure outlined above results in the coupling of the launching girder 5 simultaneously with the bridge 4 without any special procedure. After coupling is effected, an additional step is executed in that first the launching girder 5 is extended to the opposite bank 45 (FIG. 5) by means of a worm and nut drive mechanism 34 (FIG. 1) located in the tip of the laying beam 3 and is lowered onto the other bank (FIG. 6). This lowering of the launching girder 5 onto the bank is hydraulically monitored so that an exact alignment of laying beam 3, launching girder 5, and bridge 4 is ensured. The launching girder 5 is guided by means of rollers 21, 22 of the roller pairs 17, 18 which are arranged in front of the rollers 19, 20 for the bridge 4, but on the same axle 16 in the crossbeam 15. Moreover, a further roller 35 (FIGS. 4, 5) is arranged in the ramp zone by way of the pivotable auxiliary arm 31, wherein the launching girder 5 or the bridge 4 is supported.

Figure 2:
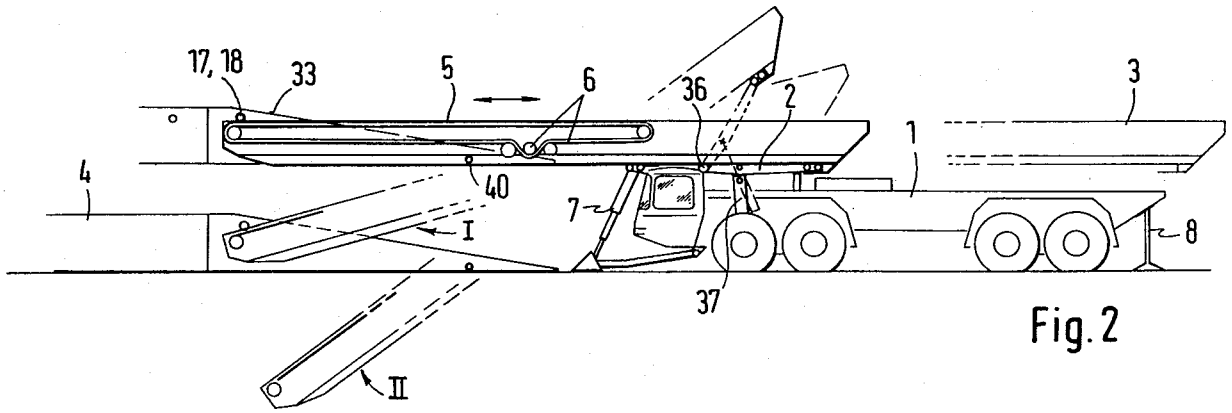
FIG. 2 shows a laying procedure for a bridge from a wheel-type vehicle in various positions.
Figure 3:
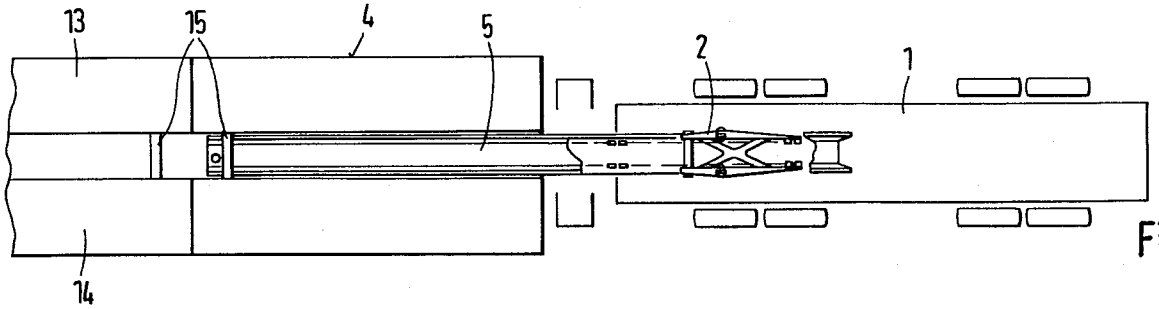
FIG. 3 is a top view of FIG. 2.

When advancing the bridge 4 onto the bank 45 on the other side, the bridge moves at an elevated level onto the edge of the bank 45. Then a hydraulic valve is operated at the cylinder 30 of the launching girder tip 29, and the bridge is thereafter lowered vertically onto the bank via the hydraulic cylinder 30. The ramp end 33 of bridge 4 is likewise lowered into position on the near bank 45 (FIG. 7) by causing the guide arm 2 to be pivoted about horizontal axis 36 by extension of the hydraulic cylinder unit 37 (FIG. 2)

While we have shown and described one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Bridge laying apparatus comprising a vehicle with devices for supporting at least two bridge sections, said bridge sections being joinable into a bridge and being superimposable for transport, as well as devices for joining of said bridge sections and laying of the bridge, wherein the bridge includes plural tracks connected to one another via crossbeams and the said devices are arranged and guided between said bridge tracks, characterized in that a laying beam with a launching girder releasably engaged therewith forms the laying device, said laying device being supported in a longitudinally displaceable manner via a guide means mounted to the vehicle and comprising roller pairs arranged on both sides of the launching girder, a respective one of these roller pairs serving for guiding and supporting the bridge on the laying beam and the other roller of the roller pairs serving for guiding and supporting the launching girder in the bridge, wherein said laying beam is displaceably attached to said vehicle, and wherein said launching girder is operable to remain with said bridge, upon disengagement of its releasable engagement with the laying beam.

2. Bridge laying apparatus according to claim 1, comprising a guide arm articulated to the vehicle and characterized in that the laying beam is held on said guide arm, and said guide arm carries guide means for the laying beam comprising rollers running on both sides of the beam in guide tracks formed on said laying beam.

3. Bridge laying apparatus according to claim 2, characterized in that the articulation of the guide arm to the vehicle is pivotable about a horizontal axle and by way of a hydraulic cylinder unit.

4. Bridge laying apparatus according to claim 1, characterized in that the laying beam has a U-shaped profile in transverse cross-section that is open toward a topside of the bridge, the launching girder being held in this U-shaped profile at a crossbeam of the bridge with said launching girder being encompassed by sidewalls of the laying beam formed by said U-shaped profile.

5. Bridge laying apparatus according to claim 1, characterized in that a worm and nut drive mechanism for extending the launching girder as well as a chain drive mechanism for the displacement of the bridge are provided in the laying beam in cooperative relation with said launching girder and bridge, respectively.

6. Bridge laying apparatus according to claim 1 or 4, characterized in that the laying beam has a forward end facing a tip of the launching girder, said forward end having a gripping device for rigidly connecting the launching girder and laying beam against movement in the longitudinal direction of the bridge.

7. Bridge laying apparatus according to claim 6, characterized in that the gripping device comprises a catch hook attached to the laying beam, a complementarily shaped opening in the launching girder for the reception of the catch hook and spring means for urging said catch hook toward said opening.

8. Bridge laying apparatus according to claim 7, further comprising a hydraulic cylinder unit, and characterized in that the catch hook is connected to said hydraulic cylinder for movement in a direction away from said opening.

9. Bridge laying apparatus according to claim 1 or 4 or 7, characterized in that a free forward end of the launching girder has a launching girder tip with a soleplate oriented toward the terrain said sideplate being connected to said girder top by a controllable hydraulic cylinder in a pivotable manner.

10. A bridge laying apparatus comprising:
(a) a vehicle;
(b) a laying beam mounted to said vehicle in a pivotal and longitudinally displaceable manner;
(c) at least two bridge sections removably and longitudinally displaceably carried by said laying beam;
(d) a launching girder formed of girder sections equal in number to said bridge sections and carried thereby so as to be displaceable relative thereto and therewith.
(e) joining means carried by said vehicle and cooperable with said bridge and girder sections for bringing said bridge sections and girder sections from a superimposed transport position to a joined position forming a bridge; and
(f) laying means carried by said vehicle and cooperatively associated with said launching girder and bridge for longitudinally displacing said launching girder and bridge separately and jointly, respectively as needed depending on the length of an obstacle to be spanned, relative to said laying beam and vehicle.

11. Bridge laying apparatus according to claim 10, wherein the displaceable mounting of said laying beam comprises a guide arm device to which said laying beam is connected, said guide arm device being articulated to the vehicle for pivotal movement, and roller-track means for enabling longitudinal movement of said laying beam including rollers and tracks on both sides of said laying beam, said rollers being attached to one of said guide arm devices and laying beam so as to run in said tracks which are formed on the other of said guide arm device and laying beam.

12. Bridge laying device according to claim 11, wherein said guide arm device further includes a hydraulic cylinder unit for causing displacement of said guide arm device about a horizontal pivot axis.

13. Bridge laying device according to claims 10 or 12, wherein said laying beam has a U-shaped profile in transverse cross-section that is open toward a topside of the bridge, the launching girder being held in this U-shaped profile at a crossbeam of the bridge with said launching girder being encompassed by sidewalls of the laying beam formed by said U-shaped profile.

14. Bridge laying device according to claims 10 or 12, comprising a gripping device at a forward end of the laying beam for detachably gripping said launching girder to hold said launching girder against relative longitudinal movement while permitting relative pivoting.

15. Bridge laying apparatus according to claim 14, wherein said gripping device comprises a latch hook attached to the laying beam, a complementarily shaped opening in the launching girder for the reception of the catch hook and spring means for urging said catch hook toward said opening.

16. Bridge laying apparatus according to claim 15, further comprising a hydraulic cylinder unit, and characterized in that the catch hook is connected to said hydraulic cylinder for movement in a direction away from said opening.

17. Bridge laying apparatus comprising a vehicle with devices for supporting at least two bridge sections, said bridge sections being joinable into a bridge and being superimposable for transport, as well as devices for joining of said bridge sections and laying of the bridge, wherein the bridge includes plural tracks connected to one another via crossbeams and the said devices are arranged and guided between said bridge tracks, characterized in that a laying beam with a launching girder partially embedded therein forms the laying device, said laying device being supported in a longitudinally displaceable manner via a guide means mounted to the vehicle and comprising roller pairs arranged on both sides of the launching girder, a respective one of these roller pairs serving for guiding and supporting the bridge on the laying beam and the other roller of the roller pairs serving for guiding and supporting the launching girder in the bridge, wherein the gripping device comprises a catch hook attached to the laying beam, a complementarily shaped opening in the launching girder for the reception of the catch hook and spring means for urging said catch hook toward said opening.

18. Bridge laying apparatus according to claim 17, further comprising a hydraulic cylinder unit, and characterized in that the catch hook is connected to said hydraulic cylinder for movement in a direction away from said opening.

* * * * *